United States Patent [19]

Tietje

[11] Patent Number: 4,564,759

[45] Date of Patent: Jan. 14, 1986

[54] CORONA DISCHARGE DEVICE

[75] Inventor: Andreas Tietje, Tariffville, Conn.

[73] Assignee: Ensign-Bickford Industries, Inc., Simsbury, Conn.

[21] Appl. No.: 535,372

[22] Filed: Sep. 26, 1983

[51] Int. Cl.[4] ..... H01T 19/04

[52] U.S. Cl. ..... 250/324; 250/326

[58] Field of Search ..... 250/324, 325, 326; 361/230

[56] References Cited

U.S. PATENT DOCUMENTS

| | | | |
|---|---|---|---|
| 3,358,289 | 12/1967 | Lee | 250/325 |
| 3,397,136 | 8/1968 | Balogh | 250/324 |
| 3,702,417 | 11/1972 | Bower et al. | 361/230 |
| 3,789,278 | 1/1974 | Bingham et al. | 250/326 |

*Primary Examiner*—Bruce C. Anderson

*Attorney, Agent, or Firm*—Hayes & Reinsmith

[57] ABSTRACT

A corona discharge device including a pair of electrically conductive electrodes arranged in spaced electrically insulated relationship with one of the electrodes comprised of a plurality of juxtaposed conductive members supported for individual longitudinal movement toward and away from the other electrode. Each individual conductive member can be identical to each other conductive member and can be provided with longitudinally offset end portions facing the other electrode, with the juxtaposed conductive members having alternating directions for the offset end portions and with the lower end of each end portion enclosed by an insulator.

11 Claims, 2 Drawing Figures

CORONA DISCHARGE DEVICE

BACKGROUND OF THE INVENTION

1. Field of the Invention

This invention relates to corona treatment apparatus particularly useful in treating plastic films and to electrode assemblies useful in such apparatus.

2. Description of the Prior Art

It is well known to treat materials such as polyethylene film by passing the material between two electrodes to improve the wetability of the surface of the film thereby to prepare the surface for coating, printing and the like. In my prior continuation-in-part application Ser. No. 523,169, filed Aug. 15, 1983, apparatus is disclosed for providing an assembly of individually removable or individually pivotable conductive members to form one of the electrodes, thereby to selectively treat desired areas of a plastic film or the like; that same application discloses use of a ceramic cup-shaped insulator for each of the conductive members. It is also known to use multiple, spaced and separately supported assemblies of conductive members to form one effective electrode assembly to overcome the problem of "streaking" in corona treatment (unwanted untreated areas caused by spacing of the individual conductive members).

OBJECTS OF THE INVENTION

It is a principal object of this invention to provide improved corona treatment apparatus having an electrode array that substantially eliminates unwanted untreated areas while permitting facile selective placement of conductive members in the electrode array to create desired untreated areas.

It is a further object of this invention to provide an improved electrode array for corona treatment apparatus comprised of substantially identical conductive members supported for longitudinal movement toward and away from the reference or second electrode.

It is a still further object of this invention to provide an improved electrode array for corona treatment apparatus having substantially identical conductive members configured with offset end portions permitting use of cup-shaped end cap insulators for each conductive member without affecting electrode spacing.

It is an additional object of this invention to provide an electrode array wherein each conductive member is provided with an easily removable and replaceable end cap insulator.

It is a further object of this invention to provide improved corona treatment apparatus which is easily manufactured from a minimum number of different parts to provide effective corona treatment over adjustable areas of the object to be treated.

Other objects will be in part obvious and in part pointed out in more detail hereinafter.

A better understanding of the objects, advantages, features, properties and relations of the invention will be obtained from the following detailed description and accompanying drawings which set forth an illustrative embodiment and is indicative of the various ways in which the principles of the invention are employed.

SUMMARY OF THE INVENTION

A corona discharge device is provided having an electrode array comprised of a plurality of electrically conductive members which are individually adjustably positioned relative to the second electrode, each conductive member in the electrode array being provided with offset end portions to permit utilization of cup-shaped end insulators while permitting the electrodes to remain in aligned juxtaposition.

DESCRIPTION OF A PREFERRED EMBODIMENT

Figure 1:
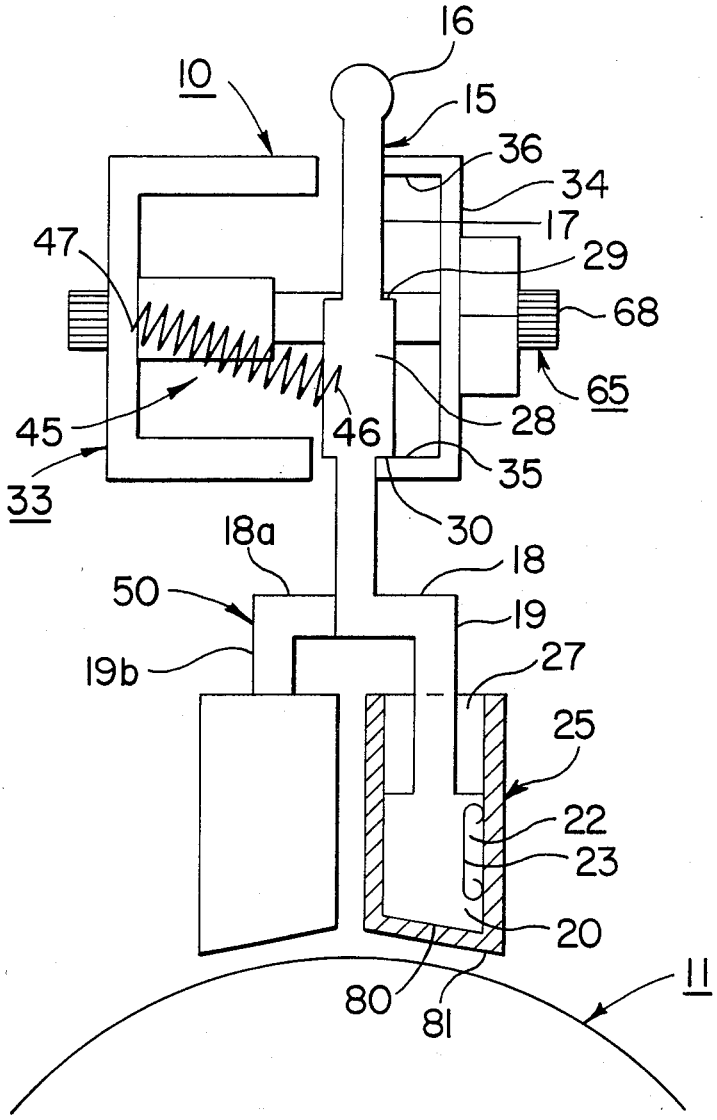
FIG. 1 is a schematic end elevation view, partially in cross-section, showing the electrode assembly of the present invention.

Turning now to the drawings and particularly FIG. 1, a schematic form of the invention is illustrated and generally comprises a first electrode 10 and a second electrode 11 supported in a suitable manner in fixed position relative to each other and connected to a suitable high voltage source to produce the desired corona discharge. Electrode 11 is shown as a portion of a cylinder, which cylinder is supported for rotation and over which a plastic film (not shown) passes under electrode 10.

Electrode 10 is comprised of a plurality of individual conductive members 15 each of which is preferably made from extruded aluminum and each of which has the identical cross-section profile shown. Conductive member 15 has an enlarged upper end portion 16, a shank portion 17, an intermediate portion 18 and an offset end portion 19. The lower end 20 of end portion 19 is enlarged in cross-sectional configuration and is provided with an appropriately shaped groove 22 in which is releasably disposed spring member 23.

Ceramic (or other suitable insulating material) cup 25 is shown in FIG. 1 in cross-section so as to reveal the internal configuration of the lower end portion of conductive member 15. The internal wall dimensions of ceramic cup 25 closely engage the front and side faces of enlarged end 20 so as to compress spring 23 thereby providing the desired frictional force to retain cup 25 in position on the end of conductive member 15. It is noted that the shape of the cup 25 and the dimensions of lower end 20 are such as to provide an insulating air space 27 in the region of the top of cup 25.

Shank portion 17 of conductive member 15 is shown with an enlarged central portion 28 which enlarged portion provides upper shoulder stop 29 and lower shoulder stop 30 which cooperate with the supporting mechanism to position conductive member 15 relative to cylinder 11. In the illustrated embodiment, the electrode array is supported by a frame 33 having a side plate 34 of generally U-shaped configuration to provide side edges 35 and 36 which cooperate with stop shoulders 29 and 30 to assist in positioning the conductive member. Side plate 34 and side plate 33 are secured together by any suitable fastening means such as the threaded fasteners 64 and 65 (see FIG. 2) (and companion fasteners not shown) thereby to establish a rigid box-like frame which supports the array of conductive members.

To enhance the easy adjustability of positioning of each individual conductive member 15, there is provided a spring 45 for each conductive member, suitably affixed at point 46 to conductive member 15 and at point 47 to frame member 33. Such an over center spring arrangement continuously urges conductive member 15 and shouler 30 into engagement with edge portion 35 of side plate 34 as illustrated. When conductive member 15 is raised, the spring is compressed, passes over center, and urges shoulder 29 into engagement with edge portion 36 of U-shaped side plate 34.

Conductive member 50 is substantially identical to conductive member 15 and, in the electrode array, is partially obscured in FIG. 1. Nonetheless, conductive member 50 has an end portion 19*a*, an intermediate portion 18*a*, shank portions and stop portions (not shown) all as described in connection with conductive member 15. An over center spring (not shown) is provided for conductive member 50 and for each other conductive member in the electrode array and the positioning of each such additional conductive member is identical to that described in connection with conductive member 15.

Figure 2:
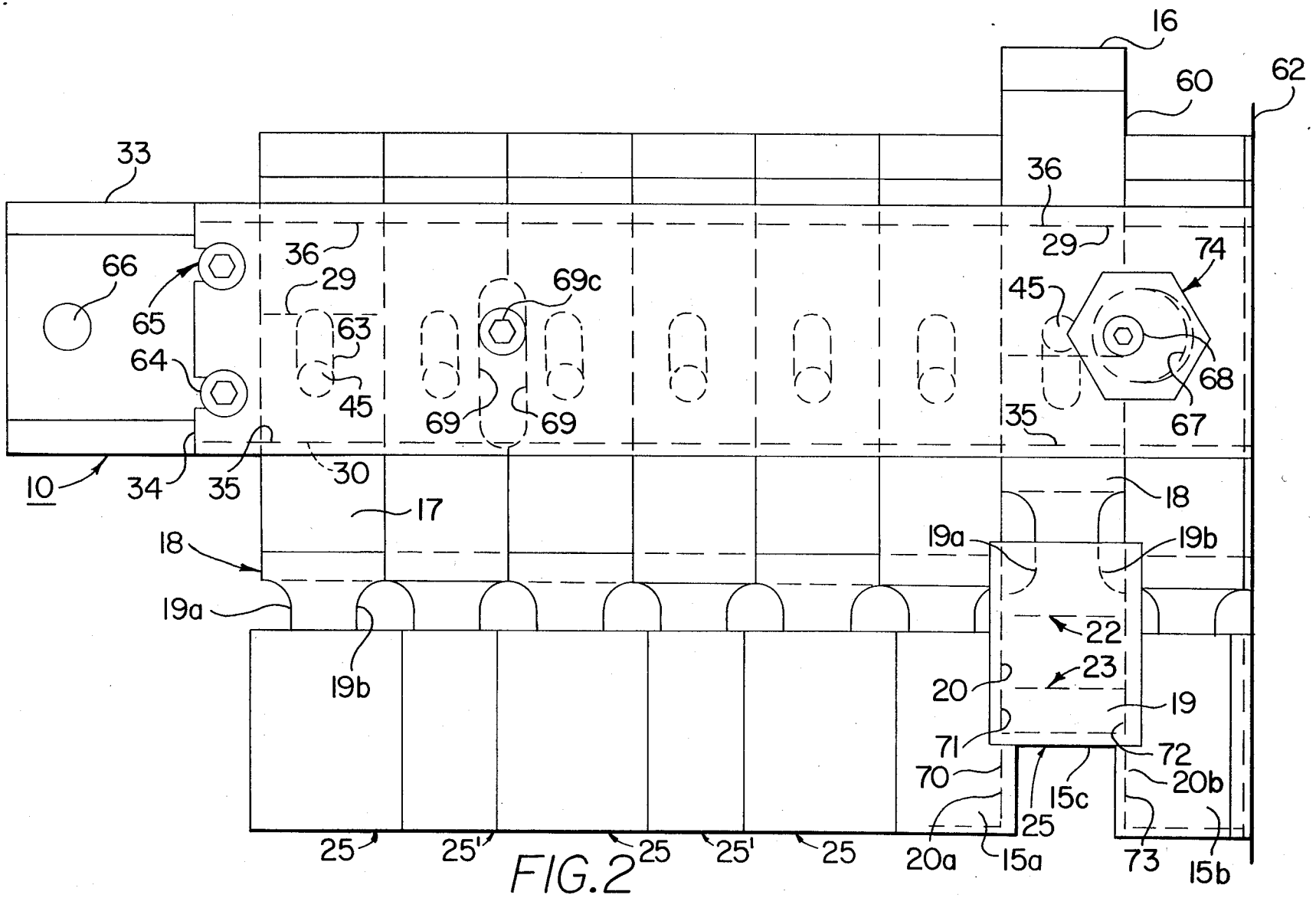
FIG. 2 is a schematic front elevation view showing an assembly of a plurality of conductive members forming a portion of the electrode array.

Turning next to FIG. 2 which illustrates additional and alternative details of the preferred embodiment, it is seen that conductive member 60, which is substantially identical to conductive member 15, is illustrated in the raised position relative to the other conductive members of the array. Line 62 merely indicates that the remainder of the electrode array may extend with as many conductive members as are desired for the particular corona treatment apparatus. With regard to each electrode illustrated in the lowered position, each stop shoulder 29 (only one of which is shown) is shown displaced from edge 36, stop shoulder 30 is shown in engagement with edge 35 of the U-shaped frame member 34, spring 45 is shown in its lower position (shown in dotted lines). The distance of travel of spring 45 is shown by dotted lines 63 which also show the upper limit of travel of spring 45. Fasteners 64 and 65 secure side plates 33 and 34 together, as desired and, an aperture 66 is provided for mounting the electrode array 10 relative to the cylindrical second electrode 11 in any desired manner.

As an alternate form of each conductive member 15, FIG. 2 shows lower end portion 19 as being "necked down" in the regions 19*a* and 19*b* to increase, if desired, the air gap spacing between the upper edges of the ceramic cup 25 and the conductive member.

Turning now in greater detail to conductive member 60 which is shown in the raised position, it is seen that the spring 45 of conductive element 60 has passed over center so as to bring stop member 29 into engagement with edge 36 and at the same time to elevate stop shoulder 30 away from edge 35 of U-shaped frame member 34. Because of the over center nature of the spring action, both the raised and lowered positions are stable positions. In the raised position, the material passing under conductive member 60 will not be treated. Such raised position also best illustrates that end portion 20 of conductive member 60 is aligned with end portions 20*a* and 20*b* of next adjacent conductive members 15*a* and 15*b* as shown by dotted lines 70, 71, and 72, 73, even though offset as shown in FIG. 1. Hence, ceramic cup 15*c* partially overlaps ceramic cups of the next adjacent conductive members 15*a* and 15*b*.

In very long arrays of conductive members, it has been found desirable to provide for adjustment of any sag that may occur in electrode 10. Such adjustment is provided by a rotatable fastener assembly 65 having eccentric shoulder 67 which, by releasing fastener 68 can be rotated to adjust the elevational positioning of the electrode. To accommodate such adjustment, selected shank portions of conductive members are relieved as at 69 and locking fastener 69*c* is provided.

It is therefore seen in FIG. 2 that each of the conductive members in the array are substantially identical in construction and configuration and are in juxtaposition. However, each offset portion 18 extends in the opposite direction of the next adjacent offset portion on the next adjacent conductive member. Hence, as best seen in FIG. 2, the first row of end insulators such as at 25 appear full width whereas the second row of end insulators (such as at 25) appear smaller but overlap the first row. The conductive member end portions remain however and without spacing across the array of those conductive end portions thereby effectively precluding unwanted streaking in the corona treatment.

An additional feature of the invention is best seen in FIG. 1 wherein the end face 80 of end portion 19 of each conductive member is at an angle relative to the effective vertical axis of each conductive member. Such an angular relationship increases the effective area of the conductive member end portion that faces the cylindrical second electrode 11 thereby to enhance the desired corona effect; ceramic cup 25 is similarly provided with an angled end face 81. It is noted that the direction fo the angled face is reversed for each adjacent conductive member and cup.

As will be apparent to persons skilled in the art, various modifications, adaptations and variations of the foregoing specific disclosure can be made without departing from the teachings of this invention.

I claim:

1. A corona discharge device comprising first electrode means and second electrode means mounted in spaced electrically insulated relationship with respect to each other, said first electrode means including a plurality of electrically conductive members, and means for independently supporting each conductive member for movement toward and away from said second electrode means, each such conductive member having a shank portion, an intermediate portion and an end portion, said end portion being laterally offset from said shank portion and connected thereto by said intermediate portion, said plurality of conductive members being supported with side edges of the shank portion of each adjacent conductive member in abutting relationship, with the intermediate portion of each adjacent conductive member extending in opposite directions and with the offset end portion of one conductive member spaced apart from the offset end portion of the next adjacent conductive member.

2. The corona discharge device of claim 1 wherein the means for supporting each conductive member provides independent longitudinal movement of each conductive member toward and away from said second electrode means.

3. The corona discharge device of claim 1 wherein the support means comprises a frame having opposed longitudinally extending, spaced, side plates at least one of which is U-shaped, the shank portion of each conductive member is located within the space between said side plates, and stop means are provided on said shank portion thereby to engage a portion of the sides of said U-shaped side plate and limit movement of the conductive member toward and away from said second electrode means.

4. The corona discharge device of claim 3 wherein an over-center spring is disposed between a side plate and the conductive member to urge said stop means into engagement with the side plate in the raised and lowered position relative to said second electrode means.

5. The corona discharge device of any of the preceding claims 1, 2, 3, or 4 wherein a cup-shaped insulator encloses the lower end of said end portion of the conductive member.

6. The corona discharge device of claim 5 wherein spring means are interposed between an inner side wall of said cup-shaped insulator and the end portion of the conductive member thereby to removeably retain said cup-shaped insulator in position.

7. The corona discharge device of claim 5 wherein said second electrode means is a rotatable cylinder whose axis of rotation is parallel to and spaced from the effective axis of alignment of said conductive members, the end faces of adjacent conductive members are oppositely angled and the end faces of said cups correspond to the conductive member thereby to increase the effective area of the end face of the conductive member facing said rotable cylinder.

8. The corona discharge device of claim 6 wherein said second electrode means is a rotatable cylinder whose axis of rotation is parallel to and spaced from the effective axis of alignment of said conductive members, the end faces of adjacent conductive members are oppositely angled and the end faces of said cups correspond to the conductive member thereby to increase the effective area of the end face of the conductive member facing said rotable cylinder.

9. The corona discharges device of claim 1 wherein each conductive member is substantially indentical in shape and size.

10. The corona discharge device of claim 9 wherein a cup-shaped insulating member encloses the lower end of the end portion of the conductive member and said end portion is necked-down adjacent the upper edge of said cup-shaped insulating member.

11. The corona discharge device of claim 1 wherein the offset end portions of said conductive members are spaced apart and parallel.

* * * * *